US005628445A

United States Patent [19]

Braddock et al.

[11] Patent Number: 5,628,445

[45] Date of Patent: May 13, 1997

[54] SHINGLE GAUGE FOR USE WITH NAIL DRIVING TOOL

[75] Inventors: C. Kerwin Braddock, Cincinnati; Dennis E. Stivers, Sardinia, both of Ohio

[73] Assignee: Senco Products, Inc., Cincinnati, Ohio

[21] Appl. No.: 465,535

[22] Filed: Jun. 5, 1995

[51] Int. Cl.[6] ..... B25C 1/04; B25C 7/00

[52] U.S. Cl. ..... 227/151; 227/120; 227/140; 227/156

[58] Field of Search ..... 227/107, 110, 227/120, 135, 137, 151, 154, 156, 140

[56] References Cited

U.S. PATENT DOCUMENTS

| | | | |
|---|---|---|---|
| 1,480,167 | 1/1924 | Kridler et al. | 227/151 |
| 2,915,754 | 12/1959 | Wandel | 227/111 |
| 3,125,761 | 3/1964 | Adams | 227/151 |
| 4,346,831 | 8/1982 | Haytayan | 227/156 |
| 5,251,371 | 10/1993 | Powers | 227/156 |
| 5,261,588 | 11/1993 | Lin | 227/120 |
| 5,267,682 | 12/1993 | Okouchi | 227/151 |

*Primary Examiner*—Scott A. Smith
*Attorney, Agent, or Firm*—Jerrold J. Litzinger

[57] ABSTRACT

A shingle gauge for use with a nail driving tool of the type having a magazine which feeds nails into a guide body to be driven through shingle elements into a roof structure and having a shingle element locating surface adjacent the guide body nose. The gauge comprises a mounting bracket fixed beneath the magazine and a gauge element slidably and pivotally supported on the bracket and shiftable therealong toward and away from the locating surface to adjust the distance therebetween to accommodate various sizes of shingle elements. A latch is attached to the gauge element and is capable of a locking engagement with the support bracket at any selected one of a plurality of predetermined positions therealong to locate and lock the gauge element at that selected position. The gauge element is pivotable between a fast position in which the latch is in locking engagement with the mounting bracket at one of the predetermined positions therealong and a second position in which the latch is out of locking engagement therewith. The gauge element is biased to its first position. The attachment between the gauge element and the latch is adjustable to provide a fine positioning adjustment of the gauge element to compensate for wear or the like.

12 Claims, 6 Drawing Sheets

SHINGLE GAUGE FOR USE WITH NAIL DRIVING TOOL

TECHNICAL FIELD

The invention relates to a shingle gauge mountable upon a nail driving tool, and more particularly to such a gauge which may be quickly and easily adjusted in position by means of an incremental positive lock and which is capable of additional fine adjustment to compensate for part wear.

BACKGROUND ART

Prior art workers have devised a number of nail driving tools by which shingles such as asphalt shingles or the like may be affixed to a roof.

Nail driving tools for this purpose are generally provided with canister-type magazines adapted to contain fasteners (in this instance roofing nails) arranged in tandem in strips which are coiled. The canister-type magazine is generally preferred for this purpose since it increases the number of fasteners which can be accommodated by the magazine, as compared to the capacity of a typical linear magazine.

The nails of a strip are arranged and held in a tandem row by any appropriate coilable means. These means may constitute tape means, paper means, wire means, plastic means or the like, all of which are well known in the art.

The shingle elements are affixed to a roof in overlapping comes. It is therefore important that each shingle element be properly aligned with respect to the shingle element it overlaps. This is true not only from the standpoint of providing a truly protective roof, but also from a visual standpoint. For many years proper alignment of the shingle elements was accomplished through the use of separate gauging or measuring devices. In recent years, prior art workers have provided a shingle gauge located directly on the nail driving tool so that the tool can first be used as a measuring or gauging device, and thereafter as a nail driving device. To this end, the nail driving tool is provided with an adjustable gauge beneath its magazine and a locating surface adjacent the nose of the tool. The gauge is brought into abutting relationship with the lower edge of the previously installed shingle element. The next shingle element to be installed in overlapping relationship therewith is so located that its lower edge abuts the locating surface associated with the nose of the tool. This is done at at least two positions along the overlapping shingle element. Once the overlapping shingle element has been properly located, the tool can then be used to nail it in place.

The gauge mounted on the tool beneath the magazine is normally made adjustable in such a way that it may be shifted toward and away from the nose of the tool so as to increase or decrease the distance between the gauge abutment surface and the locating surface associated with the tool nose. In this way, shingle elements of different sizes can be properly located by the shingle gauge. In prior art structures, to adjust the gauge for the particular shingle elements being install, it was necessary to loosen one or more nut and bolt assemblies, shift the gauge to the proper position, and thereafter tighten the one or more nut and bolt assemblies while holding the gauge in adjusted position. This was both cumbersome and time consuming.

U.S. Pat. No. 5,267,682 is exemplary of those patents teaching a nail driving tool provided with an adjustable shingle gauge. Again, adjustment of the shingle gauge requires loosening of a bolt and nut assembly, shifting of the shingle gauge, and retightening of the bolt and nut assembly.

In this instance, however, a nut and bolt loosening and tightening mechanism is provided, constituting an integral part of the gauge assembly. While this clearly represents an improvement over the prior art, it still is rather time consuming, necessitates considerable manipulation and requires that the gauge be held in the desired position until locked in place by the nut and bolt. The present invention is based upon the discovery of a quick adjustment system wherein a gauge is mount on a support located beneath the magazine of the nail driving tool and is slidable thereon toward and away from the tool nose. The gauge is fastened to a spring latch which has an upturned end receivable in any one a plurality of locking slots extending transversely of the support. The gauge is manually pivotable between locked and unlocked positions and, in unlocked position can be manually moved toward and away from the forward locating surface. Thereafter, the spring latch biases the gauge to its locked position in any selected one of the transverse locking slots. In this way, an incremental positive locking system for the gauge is provided. The gauge is also capable of being shifted with respect to the spring latch to provide a fine positioning adjustment to compensate for part wear and the like. The incremental positive locking system requires no tools, and no bolting or unbolting of elements. Locking in the desired position is immediate and the gauge does not have to be held in the desired position until locking is accomplished.

DISCLOSURE OF THE INVENTION

According to the invention there is provided a shingle gauge for use with a nail driving tool. The nail driving tool is of the type having a magazine which feeds nails into the drive track of the tool located in the guide body thereof so that they may be driven through shingle elements and into a roof structure by the tool driver. The tool is provided with a forwardly facing shingle element locating surface adjacent the guide body nose.

The shingle gauge comprises a mounting bracket fixed beneath the tool magazine. The gauge further comprises a gauge element slidably and pivotally supported on the mounting bracket. The gauge is shiftable along the mounting bracket toward and away from the locating surface to adjust the distance therebetween to accommodate various sizes of shingle elements.

A latch is attached to the gauge element and is capable of lockingly engaging the mounting bracket at any selected one of a plurality of predetermined positions along the support bracket whereby to locate and lock the gauge element at that selected position. The gauge element is pivotable with respect to the mounting bracket between a first position in which the latch is in locking engagement with the mounting bracket at one of the predetermined positions therealong, and a second position in which the latch is out of locking engagement with the mounting bracket. When in its second position, the gauge element is freely shiftable along the mounting bracket. The gauge element is biased to its first position.

The attachment between the gauge element and the latch is adjustable in directions toward and away from the locating surface whereby to provide a fine positioning adjustment of the gauge element to compensate for wear. This fine adjustment can also be used, when necessary, to assure that when the gauge of two or more tools are located in the same predetermined adjusted position on their respective mounting brackets, the distance of the gauges from their respective locating surfaces will be identical with respect to each of the nail driving tools.

DETAILED DESCRIPTION OF THE INVENTION

Figure 1:
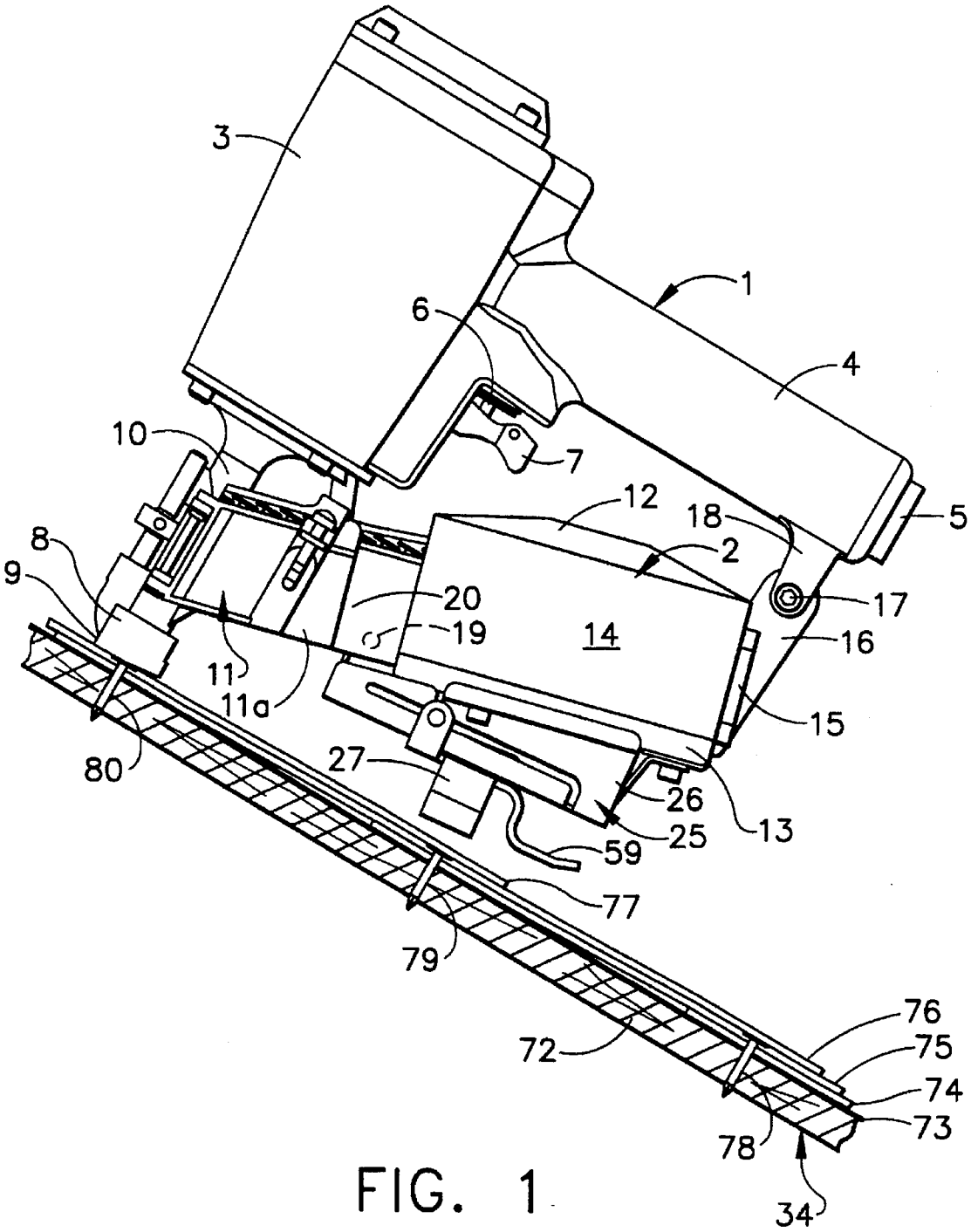
FIG. 1 is a fragmentary view illustrating a nail driving tool, provided with the shingle gauge of the present invention, and is shown nailing a shingle element to a roof structure.

Throughout the specification like parts have been given like index numerals. Reference is first made to FIG. 1 which illustrates an exemplary nail driving tool. There are numerous types of mechanism to actuate the nail driver of such a tool. For example, the driver may be actuated by a fly wheel assembly or a solenoid assembly in electrically actuated tools. There are also self-contained tools wherein the driver is actuated by internal combustion. The most common fastener driving tool is pneumatically actuated. For this reason, the tool 1 of FIG. 1 is illustrated as being a pneumatically actuated tool. The tool 1 is provided with a magazine of the canister type, generally indicated at 2. The tool 1 has a main body portion 3 and a handle portion 4.

As is well known in the art, the main body portion 3 of tool 1 contains a cylinder (not shown) having a piston/driver assembly (not shown) therein. A part of the main body portion 3 and the handle portion 4 constitute a reservoir for air under pressure. The air under pressure is introduced into the reservoir by a hose (not shown) connected to a source of compressed air (not shown). The hose is attached to the fitting 5 of the handle portion 4. The piston/driver assembly of the tool cylinder is actuated to drive a fastener by means of a normally closed main valve (not shown) at the top of the cylinder within the main body portion 3. The main valve may be opened (permitting high pressure air to actuate the piston/driver assembly to drive a nail) by means of a remote valve 6, operated by the tool trigger 7. The tool trigger 7 is usually enabled by a safety trip 8, when the safety trip 8 is pressed against a workpiece. The safety trip has a forward facing planar locating surface 9 formed thereon, the purpose of which will be apparent hereinafter.

Beneath the main body portion 3 of tool 1 there is a guide body 10. The guide body 10 contains a drive track (not shown) to accommodate a nail to be driven into the roof structure and to accommodate the lower end of the piston/driver assembly.

The tool 1 is provided with a feed mechanism, generally indicated at 11. The feed mechanism 11 may take any appropriate form. A usual and well-known feed mechanism for this purpose comprises a pawl assembly, actuable by a cylinder. After each cycle of the tool, the pawl assembly will engage the coiled strip and pull the strip incrementally from magazine 2, locating the forwardmost nail of the strip in the drive track of the guide body 10. The feed mechanism 11 is provided with a releasably lockable closure gate 11*a* which maintains the forward portion of the fastener strip properly positioned for engagement by the pawl assembly.

The canister 2 has a cylindrical body with a top 12 and a bottom 13. The cylindrical sidewall is made up of two halves, one of which is shown at 14. The half 14 is integral with the top 12. The half not shown is integral with the bottom 13. The two halves are hinged together by a hinge member 15. The half not shown and the bottom integral therewith are fixed, having an extension 16 bolted as at 17 to a lug 18 which depends from the handle 4. The forward end of the fixed portion of the magazine 2 is bolted to the feed mechanism assembly 11 by bolt 19. The cylindrical side portion 14 and the top 12 are pivotable about hinge 15 to an open position for access to the bottom 13 of the magazine 2 for purposes of loading a coil of nails thereon. At its forward end, the movable canister portion 12/14 is provided with an extension 20. When the movable portion 12/14 of canister 2 is in its closed position as shown in FIG. 1, it is maintained closed by virtue of the fact that the extension 20 is overlapped by the feed mechanism gate 11*a*.

Figure 2:
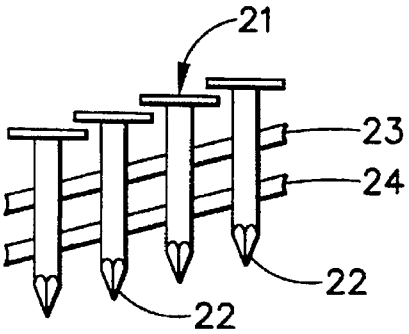
FIG. 2 is a fragmentary elevational view of a strip of roofing nails.

FIG. 2 is a fragmentary elevational view of an exemplary strip 21 of headed nails 22. The mils are arranged in a tandem row and joined together to form a strip by joining means of such nature that the strip can be coiled. In the exemplary embodiment illustrated in FIG. 2, a pair of frangible wires 23 and 24 are welded to the shank of each nail 22 to form the strip 21. As indicated above, there are other nail joining means for maintaining a series of nails in a coilable strip including tape means, paper means, plastic means and the like, all of which are known in the art.

Returning to FIG. 1, the tool 1 is completed by the provision of the gauge of the present invention, generally indicated at 25. The gauge 25 comprises a mounting bracket 26 which is affixed to the bottom 13 of magazine 2. The mounting bracket supports the gauge element 27 as will be described hereinafter. The gauge element 27 is adjustable on bracket 25 toward and away from the locating surface 9 of safety trip 8. This enables the distance between the forward edge of gauge element 27 and the locating surface 9 to be adjusted, to accommodate various sizes of shingle elements, all as will be apparent hereinafter.

Figure 3:
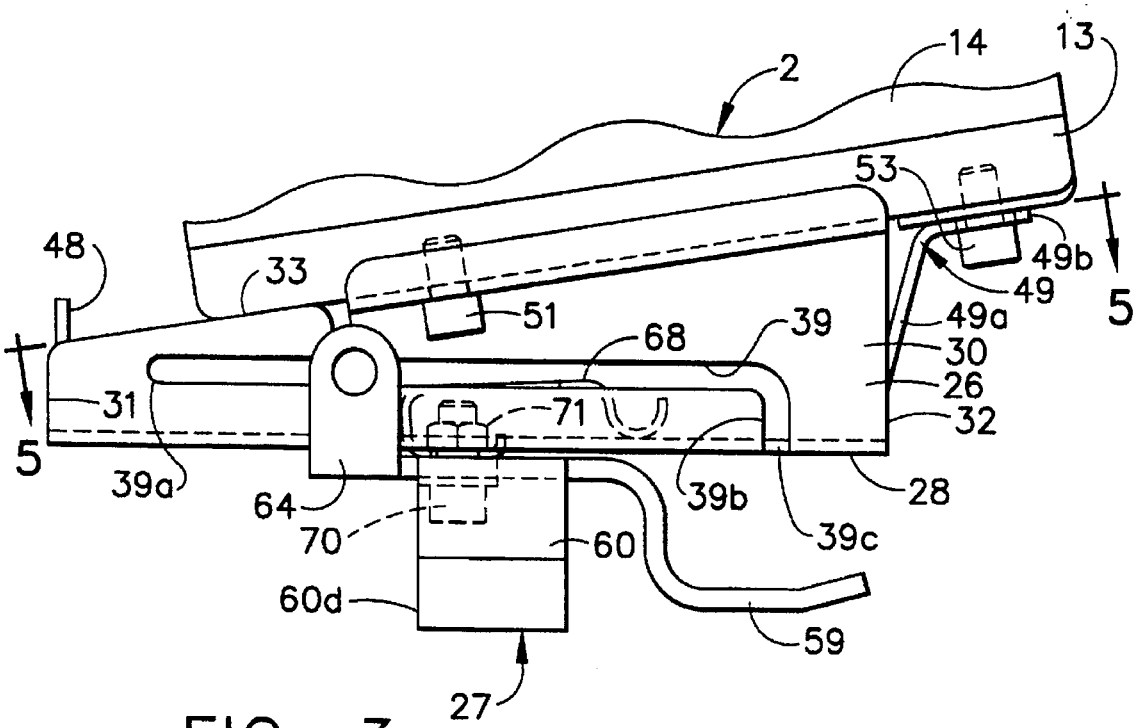
FIG. 3 is a fragmentary side elevational view of a canister-type magazine of a nail driving tool with the shingle gauge of the present invention affixed thereto.
Figure 4:
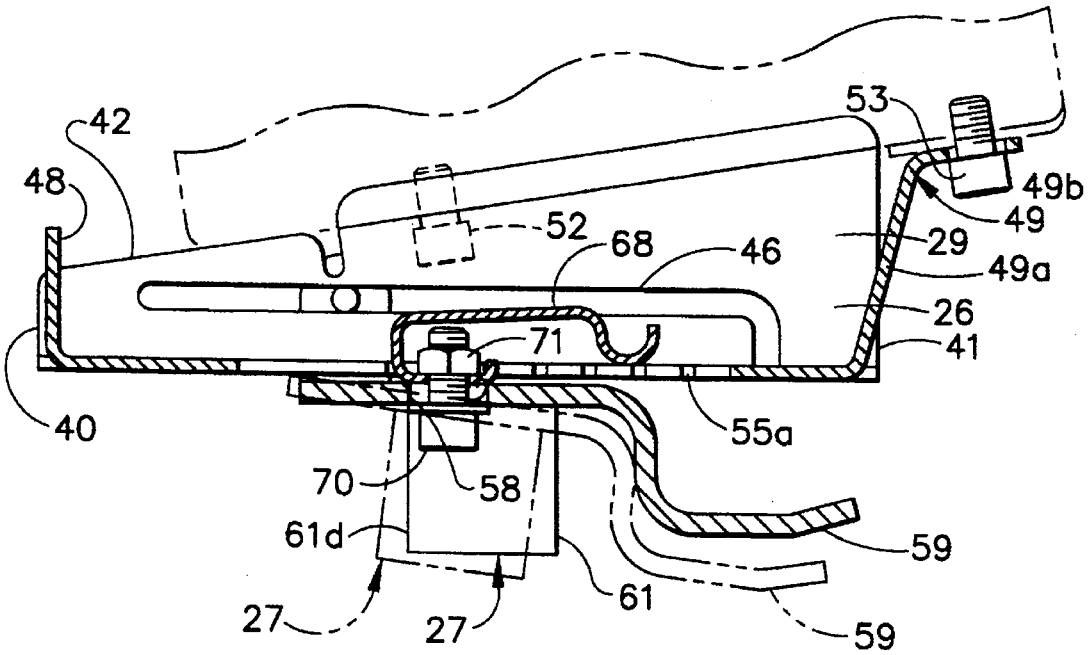
FIG. 4 is a longitudinal cross-sectional view of the structure of FIG. 3.
Figure 5:
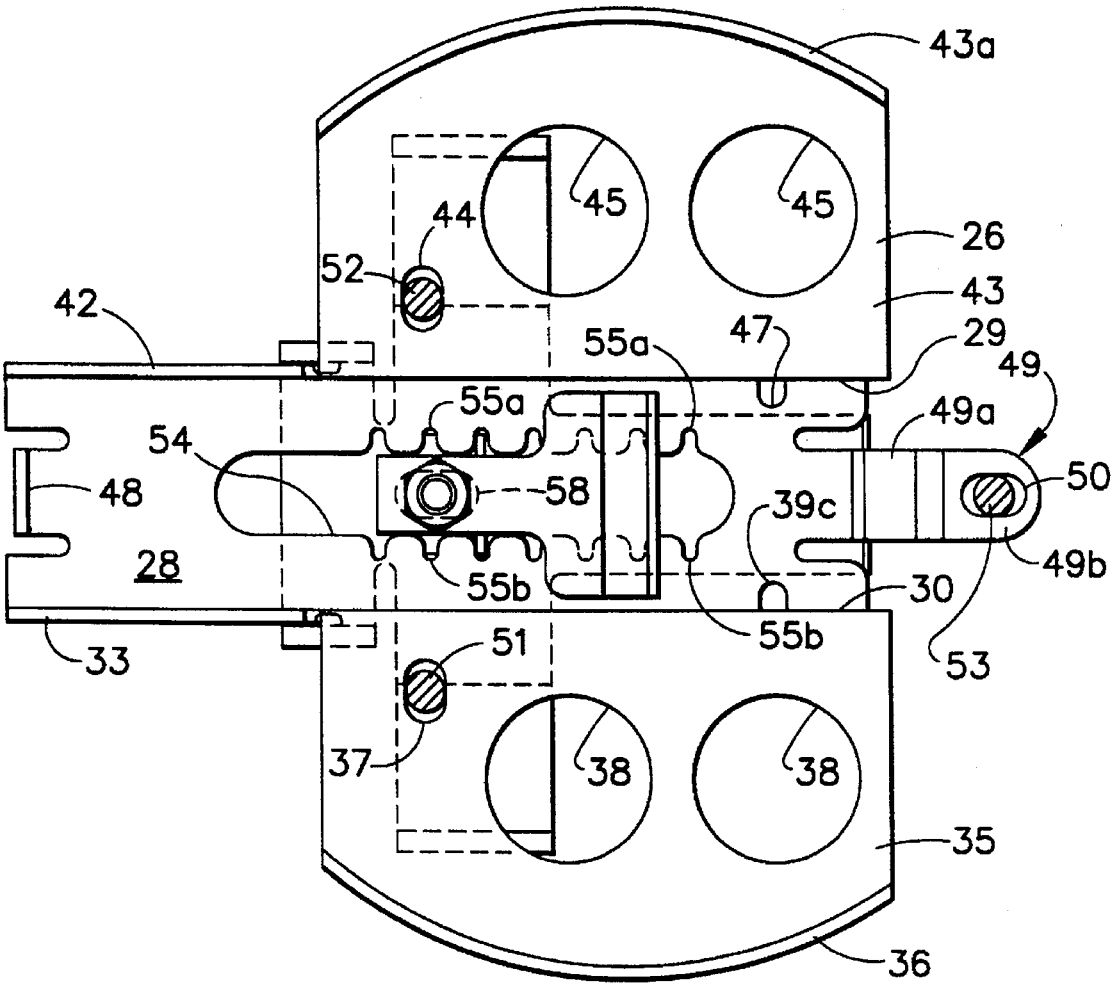
FIG. 5 is a cross-sectional plan view taken along section line 5—5 of FIG. 3.

Reference is first made to FIGS. 3, 4 and 5. Mounting bracket 26 comprises a planar base 28 with upstanding sidewalls 29 and 30. It will be noted that sidewall 30 (see FIG. 3) extends perpendicularly upwardly from base 28. Sidewall 30 has a front edge 31 and a rear edge 32, both perpendicular to base 28. Sidewall 30 also has an upper edge 33 sloping downwardly and forwardly from edge 32 to edge 31. As a result of this configuration, the base 28 of mounting bracket 26 is essentially parallel to the roof structure as shown in FIG. 1, wherein the roof structure is generally indicated at 34. At the same time, the upper edge 33 of sidewall 30 is parallel to the bottom of canister magazine 2. The sidewall 30 along upper edge 33 has a laterally directed planar extension 35 terminating in an upstanding rim 36 having an inside diameter approximating the outside diameter of magazine bottom 13. Extension 35 is provided with an elongated bolt hole 37. It may also be provided with additional holes 38 for weight savings.

Sidewall 30 is completed by the provision of an elongated rectilinear slot 39 (see FIG. 3). At its forward end, slot 39 terminates in a rounded portion 39*a*. At its rearward end, the slot turns vertically downwardly as at 39*b* and terminates in a rounded surface 39*c* in base 28 (see also FIG. 5).

The sidewall 29 is a mirror image of sidewall 30 having front and rear edges 40 and 41, a downwardly and forwardly sloping upper edge 42, an extension 43 directed laterally from edge 42 and terminating in an upstanding arcuate rim 43*a* equivalent to rim 36. The extension 43 may be provided with an elongated bolt hole 44, equivalent to bolt hole 37, and additional holes 45 equivalent to the holes 38 in extension 35.

As is most clearly shown in FIG. 4, sidewall 29 has an elongated slot 46 formed therein which is a mirror image of the slot 39 of sidewall 30 and which extends partway into base 28, as at 47 (see FIG. 5).

At the forward end of mounting bracket 26 a tab 48 extends vertically upwardly from base 28. At its rearward end, the base 28 is provided with a second tab generally indicated at 49. The tab 49 has a first portion 49*a* which slopes upwardly and rearwardly from base 28 and a second portion 49*b* which also slopes upwardly and rearwardly in a plane parallel to the edges 42 and 33 of sidewalls 29 and 30. The portion 49*b* of tab 49 is provided with an elongated bolt hole 50.

As is apparent from FIGS. 1, 3, 4 and 5 the mounting bracket 26 is affixed to the bottom 13 of magazine 2 by three machine screws 51, 52 and 53 extending respectively through bolt holes 37, 44 and 50 and threadedly engaged in the bottom 13 of magazine 2.

Mounting bracket 26 is completed by the provision of an elongated, centrally oriented, longitudinal slot 54 formed in base 28. The slot 54 is provided with pairs of laterally extending locking slots 55*a*–55*b* evenly spaced therealong. The purpose of the locking slots will be apparent hereinafter.

Figure 6:
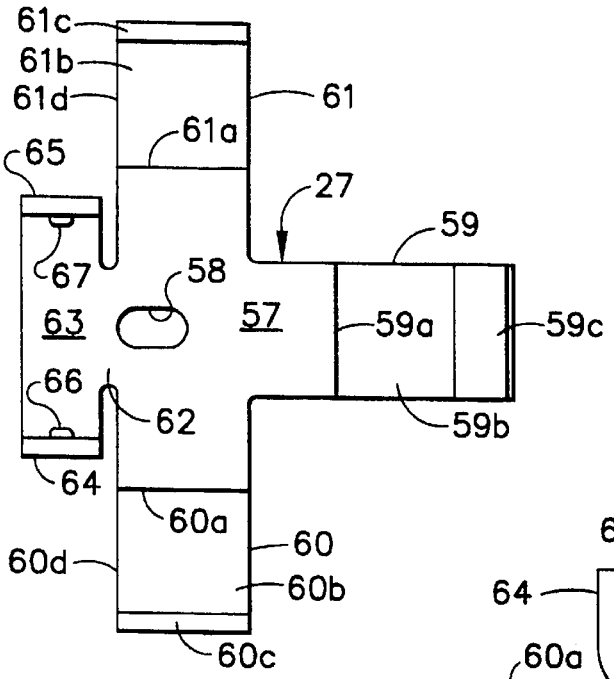
FIG. 6 is a plan view of the gauge element of the present invention.
Figure 8:
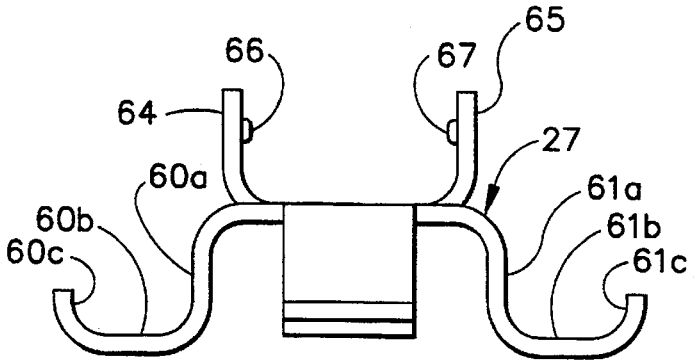
FIG. 8 is an end elevational view of the gauge element as seen from the right of FIG. 7.
Figure 7:
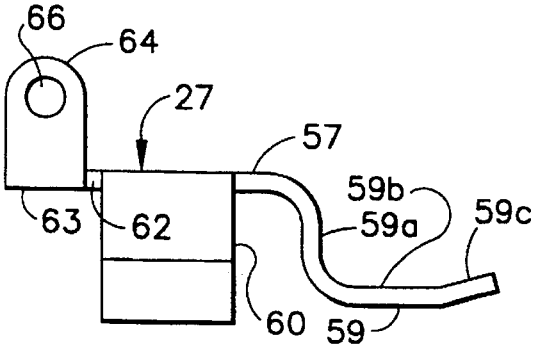
FIG. 7 is a side elevational view of the gauge element of FIG. 6.

Reference is now made to FIGS. 6, 7 and 8 wherein the gauge element of the present invention is illustrated. The gauge element is generally indicated at 56 and has a planar central body portion 57 with an elongated hole 58 formed therein, the purpose of which will be apparent hereinafter. The central body portion 57 has a rearward extension 59 comprising a first downwardly extending portion 59*a*, a rearwardly extending portion 59*b* and a slightly upturned endmost portion 59*c*. The extension 59 constitutes a handle, as will be apparent hereinafter.

Figure 9:
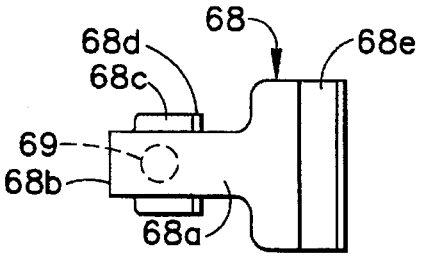
FIG. 9 is a plan view of the spring latch of the present invention.
Figure 10:
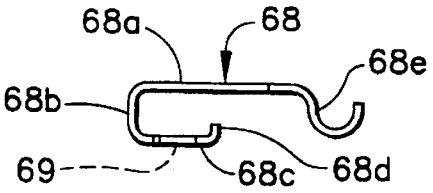
FIG. 10 is a side elevational view of the spring latch of FIG. 9.
Figure 11:
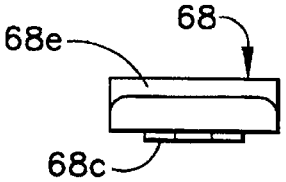
FIG. 11 is an end elevational view of the spring latch as seen from the right of FIG. 10.

The central body portion 57 has a first lateral extension 60 comprising a downwardly sloping portion 60*a*, a laterally extending portion 60*b* and an upturned portion 60*c*. In a similar fashion, the central body portion 57 27 has an oppositely directed lateral extension 61 having a downwardly extending portion 61*a*, a laterally extending portion 61*b* and an upturned endmost portion 61*c*. At its forward end, the central body portion 57 has a neck 62 terminating in a planar portion 63. The neck 62 and planar portion 63 are coplanar with the central body portion 57. At its sides, the portion 63 terminates in upstanding members 64 and 65. The upstanding member 64 and 65 have coaxial, opposed protrusions thereon, shown at 66 and 67. The protrusions 66 and 67 may be formed from material of upstanding members 64 and 65, respectively, or they may constitute separate elements affixed thereto. The purpose of the protrusions 66 and 67 will be apparent hereinafter. The forward edges 60*d* and 61*d* of lateral extensions 60 and 61 constitute the gauging surfaces of gauge element 27. Reference is now made to FIGS. 9, 10 and 11. In these Figures, the a spring latch is shown at 68. The spring latch is made of spring metal and has an elongated body portion made up of a first planar portion 68*a*, a downwardly depending portion 68*b*, a portion 68*c* which is essentially parallel to portion 68*a* and of a greater width (as is shown in FIG. 9). The portion 68*c* terminates in an upturned edge portion 69*d*. The portion 68*c* also has formed therein a perforation 69.

The portion 68*a* of spring latch 68 terminates at its free end in a hook shaped portion 68*e*. As will be apparent from FIGS. 4 and 5, the portions 68*a* and 68*b* are of a width slightly less than the width of longitudinal slot 54 at the mounting bracket 26. Latch portions 68*c* and 68*d* are of a width such that the portion 68*d* will extend into any one of the opposed pairs of lateral notches 55*a*–55*b*. Finally, the spring latch portion 68*e* is of a width to be comfortably received between the mounting bracket sidewalls 29 and 30.

As will be evident from FIGS. 4 and 5, the gauge element 27 is captively attached to the mounting bracket 26 by engaging protrusions 66 and 67 of the gauge element in the slots 39 and 46. It will be evident that the portions 39*c* of slot 39 and the portion 47 of slot will permit this to happen. The spring latch 68 is located within the mounting bracket 26, between its walls 29 and 30. The spring latch is turned in such a way that its portions 68*a*, 68*b*, 68*c* and 68*d* will extend through slot 54 in the mounting bracket. Once this is accomplished, the spring latch is moved to the position shown in FIGS. 3 and 4 with the hook-shaped portion 68*e* thereof abutting the top surface of mounting bracket base 28. A bolt 70 extends through elongated hole 58 of gauge element 27 and through the perforation 69 of spring latch 68. The bolt 70 is provided with a nut 71 and the bolt 70 and nut 71 fasten spring latch 68 and gauge element 27 together.

It will be evident from FIG. 4 that the spring latch 68 together with the gauge element protrusions 66 and 67 in slots 39 and 46 maintain the gauge element 27 in the position shown. In the position shown in FIG. 4, the upstanding end edge 68*d* of spring latch 68 is located within one of the sets of transverse slots 55*a*–56*a* of the mounting bracket. It will be equally evident that if the handle portion 59 of gauge element 27 is pushed downwardly (as viewed in FIG. 4) the gauge element 27 will pivot about the protrusions 66 and 67 shifting downwardly by an mount sufficient to disengage the upturned end 68*d* of spring latch 68 from that set of transverse slots 55*a*–55*b* in which they were engaged. This is shown in FIG. 4 in broken lines. Thereafter, the gauge may be shifted toward or away from the surface 9 on the safety trip 8 and the edge 68*d* of the spring latch can be caused to enter any desired one of the transverse notches 55*a*–55*b*, locking the gauge element 27 at another desired position with respect to the mounting bracket 26.

From the above description it will be evident that file gauge element 27 can be unlocked from the mounting bracket 26 by simply pressing downwardly on the gauge element handle 59. The gauge can then be shifted forwardly or rearwardly along the mounting bracket 26 and can be locked to the mounting bracket 26 at a predetermined desired position therealong by simply releasing the gauge element handle 59 and allowing the edge 68*d* of spring latch 68 to enter the desired pair of lateral slots 55*a*–55*b* in the mounting bracket base 28.

Referring to FIGS. 4 and 6, it will be noted that the perforation 58 in the central body portion of the gauge element 27 is slightly elongated. This allows a modest adjustment of the gauge element 27 with respect to the spring latch 68 to compensate for wear of the parts and the like. This is accomplished by loosening the bolt 70, making the adjustment and then tightening the bolt again. This kind of fine adjustment should not have to be made often. When two or more people are working on the roof, each provided with a nail driving tool, one or all may be finely adjusted, if needed, to assure that when the spring latch end edge 68*d* of each spring latch is located in the same predetermined pair of transverse slots 55*a*–55*b* the distance between the locating surface 9 and the gauge element gauging surfaces 60*d* and 61*d* will be the same for all of the nail driving tools.

Figure 1A:
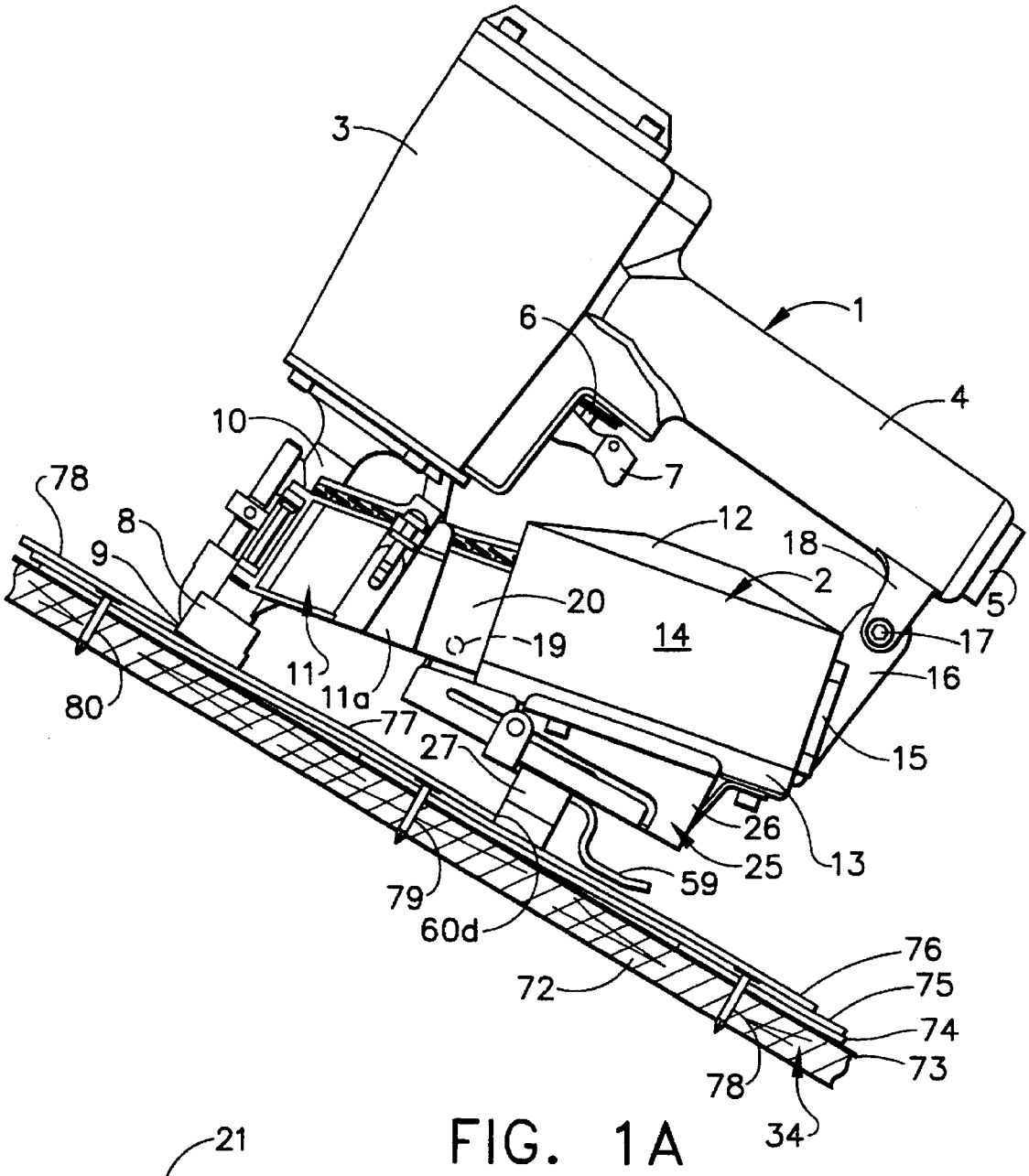
FIG. 1A is a fragmentary view of the structure of FIG. 1 illustrating the use of the shingle gauge to properly locate a shingle element.

FIG. 1 illustrates a roof structure generally indicated at 34. The roof structure comprises a plywood or other appropriate base 72 covered with a layer of appropriate waterproof material 73. The shingle elements are arranged in side-by-side manner to form courses extending across the roof. The shingle elements of each course overlap the shingle elements of the previous laid course. In FIG. 1, nail 78 passes through shingle element 74 of a first course and shingle element 75 of a second course. Similarly, nail 79 passes through single element 75 and shingle element 76. Finally, the nail 80, being driven in FIG. 1, passes through shingle element 77 and shingle element 76. As indicated above, for the roof to be functional and aesthetically correct, it is necessary that each shingle element be properly placed with respect to the adjacent previously nailed shingle element. Reference is made to FIG. 1A. With the proper distance having been set between the forward locating surface 9 and the gauging edges 60*d* and 61*d* of gauge element 27, the tool 1 is so located that the gauging surfaces 60*d* and 61*d* of gauge element 27 are in abutting relationship with the bottom edge of the just nailed shingle element 77. The new shingle element 78 is located on the roof assembly in such a manner that its lower edge abuts locating surface 9. This same gauging step is performed at several positions along the lower edge of shingle element 78 to properly locate it. If two men are working side-by-side, each provided with a nail driving tool, the gauging steps for shingle 78 can be performed simultaneously. Once shingle 78 is properly located, the tool will be used to nail it to the roof structure in the manner shown in FIG. 1.

Figure 12:
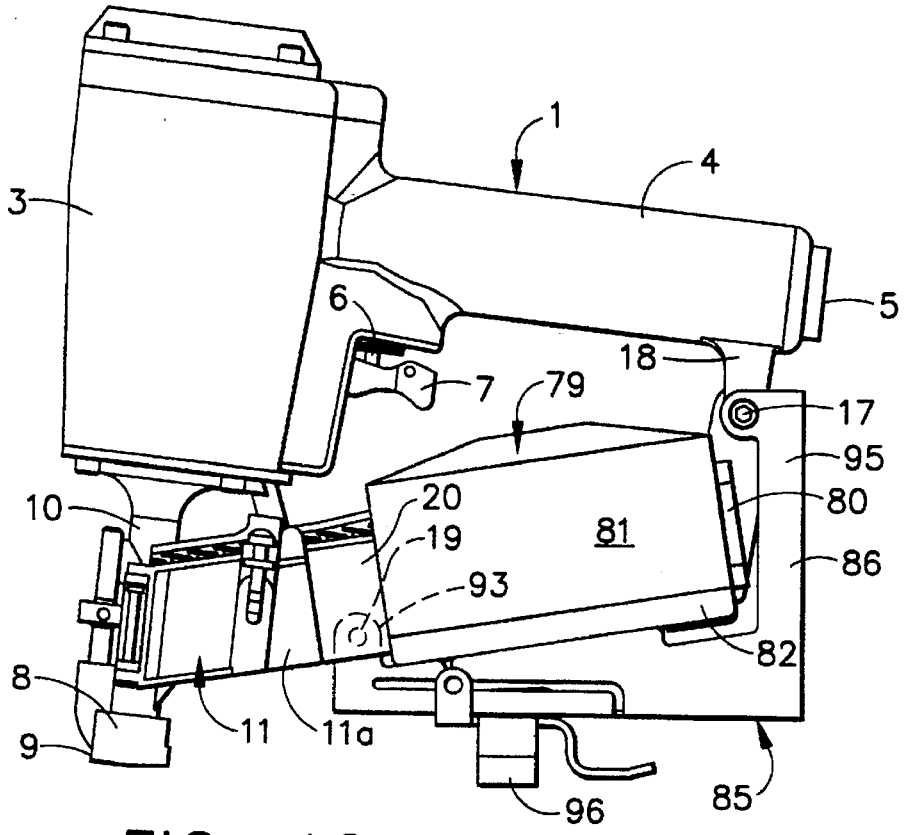
FIG. 12 is a side elevational view of a nail driving tool, identical to that of FIG. 1, provided with the gauge of the present invention having a modified mounting bracket.
Figure 13:
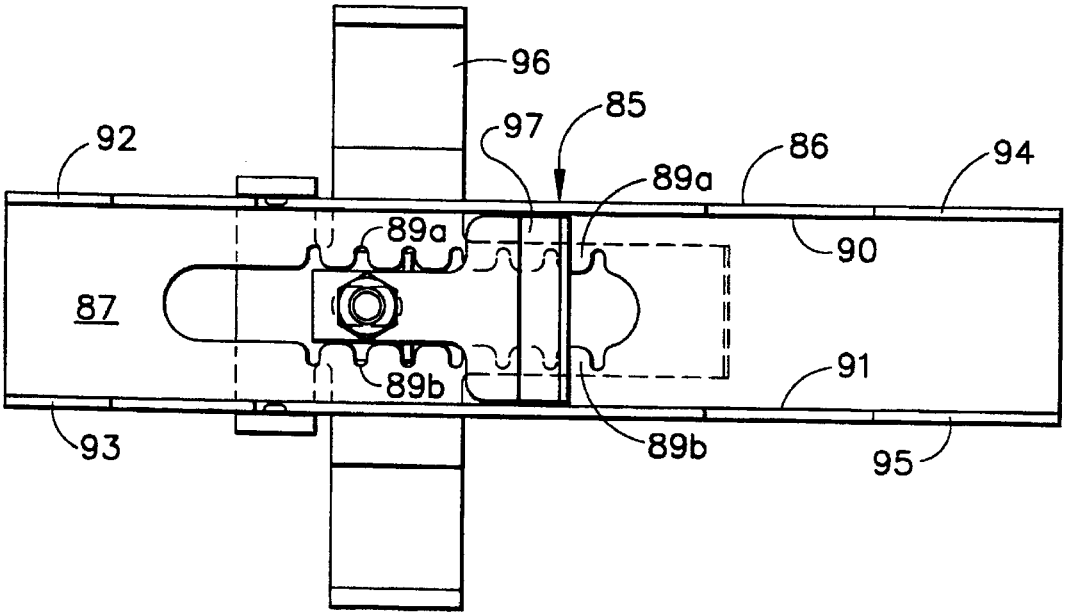
FIG. 13 is a plan view of the gauge assembly of FIG. 12.

Reference is now made to FIG. 12. The tool 1 of FIG. 12 is substantially identical to the tool 1 of FIGS. 1 and 1A and like parts have been given like index numerals. In this instance, however, the tool is provided with a canister-type magazine generally indicated at 79. The canister magazine has a cylindrical body and again is of the type having a fixed portion and an openable portion for purposes of loading the magazine with a coil of roofing nails. In this instance, the cylindrical wall of the canister is again divided into two halves, which are hinged together by hinge member 80. Unlike magazine 2 of FIG. 1, visible half 81 of magazine 79 is integral with the bottom 82 so that when the magazine is opened, the side 81 and the bottom 82 swing away from the fixed sidewall (not shown) and out from under the top 83. The movable wall 81 and bottom 82 are provided with a forward extension 84 which is engaged by the gate 11*a* to maintain the canister closed. In the embodiment of FIG. 12, the gauge, generally indicated at 85, is identical to the gauge 25 of FIG. 1 in all respects except for the provision of a modified mounting bracket 86. Referring both to FIGS. 12 and 13, the mounting bracket 86 has a base portion 87 similar to the base portion 28 of FIG. 5 and provided with a longitudinal slot 88 identical to longitudinal slot 54. The slot 88 has a plurality of pairs of transverse slots 89*a*–89*b* identical to the transverse slots 55*a*–55*b* in FIG. 5. The base is provided with upstanding sidewalls 90 and 91 which have substantially the same peripheral shape as the sidewalls 29 and 30 of FIG. 5 with several exceptions. The sidewalls 90 and 91 are provided at their forward ends with upstanding perforated lugs 92 and 93, respectively, by which the mounting bracket 86 is affixed to a portion of the guide body 10 and its feed mechanism 11. Near their rearward ends, the mounting bracket sidewalls 90 and 91 have a pair of elongated upstanding members 94 and 95 provided at their upper ends with appropriate perforations by which they are affixed to the handle lug 18 by means of the bolt 17. Thus, the overall gauge 85 is affixed to the tool 1, itself, rather than to the magazine portion thereof. It will be noted that the sides 90 and 91 are provided with elongated slots identical to the slots 39 and 46 of FIGS. 3 and 4, and which serve the identical purpose. The sidewalls 90 and 91 are not provided with extensions equivalent to the extensions 35 and 42 of FIG. 5 so that there will be no interference with the opening and closing of canister 79. The gauge 85 is provided with a gauge element 96 identical to the gauge element 27 of FIGS. 6, 7 and 8, and a spring lock 97, identical to the spring lock 68 of FIGS. 9, 10 and 11. These elements function in exactly the same manner described with respect to the embodiment of FIGS. 1, 1A and 3 through 11.

As used herein and in the claim, words such as "front", "rear", "top", "bottom", "uppermost", and "lowermost", are used herein and in the claims in conjunction with the drawings. As will be appreciated by one skilled in the art, during nailing operations, tools of the type taught herein can assume various orientations.

Modifications may be made in the invention without departing from the spirit of it.

What is claimed:

1. A shingle gauge for use with a nail driving tool of the type having a guide body containing a drive track and terminating in a nose portion, together with a magazine for nails operatively connected to said drive track, a shingle locating surface on said tool adjacent said nose portion, said gauge comprising a mounting bracket fixed beneath said magazine and containing a plurality of predetermined slots therealong, a gauge element slidably supported on said mounting bracket and shiftable therealong toward and away from said locating surface, a latch attached to said gauge element and capable of a releasable locking engagement with said mounting bracket at any selected one of said plurality of predetermined locking slots therealong, whereby to positively locate and lock said gauge element at a selected position establishing a desired distance between said locating surface and said gauge element.

2. The shingle gauge claimed in claim 1 wherein said gauge element is pivotable with respect to said mounting bracket between a first position in which said latch is in said locking engagement with said mounting bracket and a second position in which said latch is out of locking engagement therewith, said gauge element being biased to said first position.

3. The shingle gauge claimed in claim 1 wherein said attachment between said latch and said gauge element is adjustable, whereby to provide a fine positioning adjustment therebetween to compensate for wear.

4. The shingle gauge claimed in claim 1 wherein said nail driving tool has a main body portion from which said guide body depends and a handle portion, said guide body having a rearward extension, said mounting bracket operatively attached to said guide body extension and said handle portion.

5. The shingle gauge claimed in claim 1 wherein said mounting bracket is attached directly to said magazine.

6. The shingle gaug claimed in claim 1 wherein said magazine is a canister type magazine for a coiled strip of said nails.

7. The shingle gauge claimed in claim 1 wherein said mounting bracket extends longitudinally of said tool and comprises compresses an elongated bracket of U-shaped cross section, said mounting bracket having a planar base and upstanding sides, said base having a central longitudinal slot formed therein with said locking slots defining pairs of laterally aligned locking slots extending laterally from said longitudinal slot and evenly spaced therealong, said mounting bracket sides each having an elongated, longitudinal slot formed therein parallel to said base, said slots on said bracket sides having a rearward portion extending downwardly to said base and transversely into said base for a distance less than half the width of said base.

8. The shingle gauge claimed in claim 7 wherein said gauge element comprises a planar body portion with a rearwardly extending handle portion, laterally and downwardly extending portions, coplanar gauging surfaces on said lateral portions, and a forward portion having a pair of upstanding, parallel members so spaced as to be locatable to either side of said mounting bracket, each upstanding member of said pair having a protrusion thereon, said protrusions being opposed and coaxial, said protrusions being receivable in said mounting bracket side wall slots through their extensions in said mounting bracket base whereby said gauge element is slidable longitudinally of said mounting bracket and pivotable with respect thereto about said protrusions.

9. The shingle gauge claimed in claim 7 wherein said latch comprises a spring metal member having a U-shaped configuration comprising a base portion and fast and second leg portions, said first leg portion underlying said mounting bracket base and being affixed to said planar body portion of said gauge element by means of a nut and bolt assembly, said bolt passing through holes formed in said latch first leg portion and said gauge element body portion, said latch first leg portion having a fee end terminating in an upstanding latching flange so sized as to be receivable in any one of said pairs of locking slots in said mounting bracket base, said base portion of said latch extending through said mounting bracket longitudinal slot, said second latch leg portion overlying said mounting bracket base and terminating in a hook shaped portion contacting said mounting bracket base, said gauge element being pivotable by said handle between a first locked position wherein said latching flange of said latch is received in one of said locking slot pairs in said mounting bracket base and a second position wherein said latching flange of said latch is out of locking engagement with said mounting bracket enabling shifting of said gauge element along said mounting bracket, said latch biasing said gauge element to said first position.

10. The shingle gauge claimed in claim 9 wherein one of said holes in said first leg of said latch and in said body of said gauge element is elongated whereby said gauge element may be shifted longitudinally with respect to said latch to provide a free positioning adjustment of said gauge element to compensate for wear.

11. The shingle gauge claimed in claim 10 wherein said nail driving tool has a main body portion from which said guide body depends and a handle portion, said guide body having a rearward extension, said mounting bracket being operatively attached to said guide body extension and said handle portion.

12. The shingle gauge claimed in claim 10 wherein said mounting bracket is attached directly to said magazine.

* * * * *